United States Patent [19]

Hatakeyama

[11] 4,352,490

[45] Oct. 5, 1982

[54] DEFLECTING DEVICE FOR SORTER OR THE LIKE

[75] Inventor: Noboru Hatakeyama, Hachioji, Japan

[73] Assignee: Konishiroku Photo Industry Co., Ltd., Tokyo, Japan

[21] Appl. No.: 210,136

[22] Filed: Nov. 24, 1980

[30] Foreign Application Priority Data

Nov. 27, 1979 [JP] Japan ..... 54-153384

[51] Int. Cl.[3] ..... B65H 29/58

[52] U.S. Cl. ..... 271/289; 271/303

[58] Field of Search ..... 271/289, 302, 303, 207

[56] References Cited

U.S. PATENT DOCUMENTS 3,944,217 3/1976 Greene ..... 271/289

4,131,041 12/1978 Lüdemann ..... 271/294 X

*Primary Examiner*—Richard A. Schacher

*Attorney, Agent, or Firm*—Linda G. Bierman; Jordan B. Bierman

[57] ABSTRACT

A deflecting device for a sheet sorter includes a sheet receiving and transporting assembly having a conveyor system for receiving recording sheets and for transporting the sheets to a collating device, and a main sheet tray overlying the conveyor system. A deflector disposed at an inlet end of the receiving and transporting assembly is movable between a first position in which an upper plate of the deflector forms a continuation of the main tray and sheets are directed onto the main tray, and a second position in which sheets are directed by a lower plate of the deflector to the conveyor system for transport to the collating device. The deflector is connected by a force regenerative device to a control assembly for moving the same between its first and second positions so that when the control assembly firmly and positively shifts between those positions—and the deflector, in conjunction with the main tray, is supporting a sufficiently weighty load of sheets to interfere with its normal movement—the deflector is not positionally shifted until the interfering load is removed from the main tray. Upon such removal, the force regenerative device causes the deflector to be immediately shifted as intended.

5 Claims, 6 Drawing Figures

DEFLECTING DEVICE FOR SORTER OR THE LIKE

BACKGROUND OF THE INVENTION

The present invention relates to a deflecting device for use in a sorter or the like which is connected to a recording apparatus such, for example, as a copying apparatus, to perform a collating operation.

An apparatus described in Japanese Laid-Open Patent Application No. 144333/1978 is well known prior art for a deflecting device. In that apparatus, a deflecting plate is provided for movement between a first position in which the plate serves as an ordinary receiving plate for copy sheets ejected from a recording apparatus, and a second position in which the plate serves to direct copy sheets toward a sorter.

In a deflecting device having such functions, when the upper plate of the deflecting means is utilized as a copy sheet receiving tray and a number of copy sheets stacked thereon, the weight of the sheets during an operative shift of the deflecting means overloads its driving system, possibly causing damage thereto. For this reason, a conventional deflecting device is so designed that the deflecting plate or tray can not be shifted or moved from its first to its second position—based on an output signal of a sheet detecting means—unless copy sheets stacked on the plate are first removed therefrom. However, in such a construction, even a very few copy sheets stacked on the tray of the deflecting means hinders resumption of the collating operation by a sorter, necessitating the aid of persons versed in copying work and significantly lowering the efficiency of the copying operation.

SUMMARY OF THE INVENTION

The present invention, in an effort to solve the foregoing problems, proposes a deflecting device operable even when copy sheets are stacked on the plate of the deflecting means.

The apparatus according to the present invention provides that the plate of the deflecting means serves as a part of the main tray of which the greater part is used for supporting the larger portion of the sheets stacked thereon. In addition, the deflection changeover means is designed to avoid damage to the apparatus even when the deflecting means plate is operated while loaded with a large quantity of copy sheets.

The present invention is illustrated in further detail with reference to an embodiment of the sorting device in conjunction with the accompanying drawings.

DETAILED DESCRIPTION OF THE PREFERRED EMBODIMENT

FIGS. 1 to 4 illustrate a sorter provided on a freely movable platform car 1. Platform car 1 carries a vertically extending support frame 2 having a sheet receiving and transporting means (hereinafter occassionally referred to as a sheet receiving means) 3, a sheet distribution transport means 4, and a plurality of bins 5.

Figure 1:
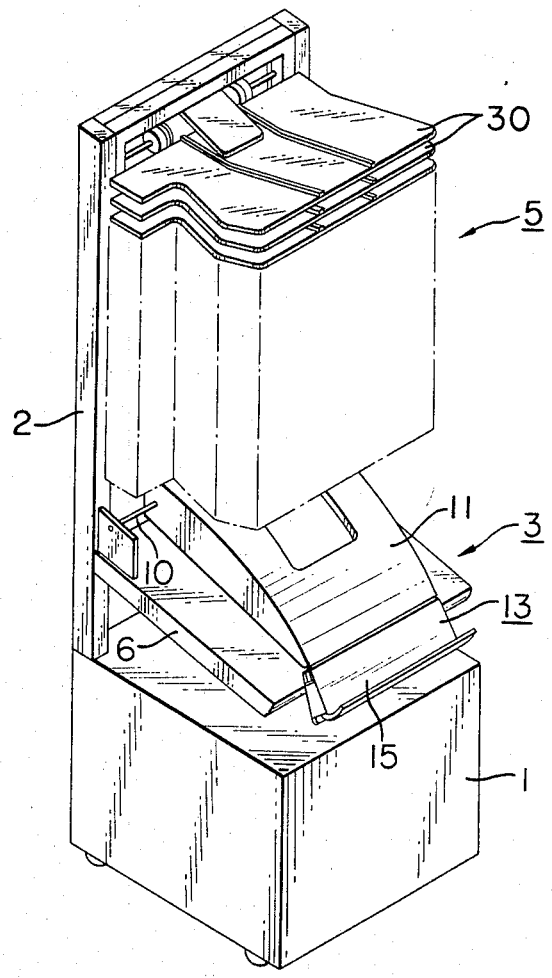
FIG. 1 is a perspective view of an overall sorter assembly embodying the present invention.

Sheet receiving means 3 comprises a box-shaped rack 6 carried on support frame 2 and having an opening (no reference symbol) defined at the upper side thereof. The angle of tilt of sheet receiving means 3 can be adjusted by a control means (not shown) in accordance with the height of an ejecting portion B for the sheet path of a copying apparatus A. Rack 6—which is ramped or angled downward toward its front end—is provided therewithin with two pairs of pulleys 7 and 8, both of which are connected to each other through endless transport belts 9 that are partially exposed above the rack. A principal copy sheet or main tray 11 is pivotally mounted for partial rotation about a shaft mounted on rack 6 and defining an axis 10 (FIG. 1). The upper surface of main tray 11 is formed with a gently sloping surface as a whole and includes an opening (no reference symbol) provided centrally therein. At the bottom of main tray 11 are disposed a plurality of driven rollers 12 which are rotatably in contact with the upper surface of endless belts 9, such that a copy sheet brought into sheet receiving means 3 from copying apparatus A is transported between transport belts 9 and driven rollers 12.

Figure 2:
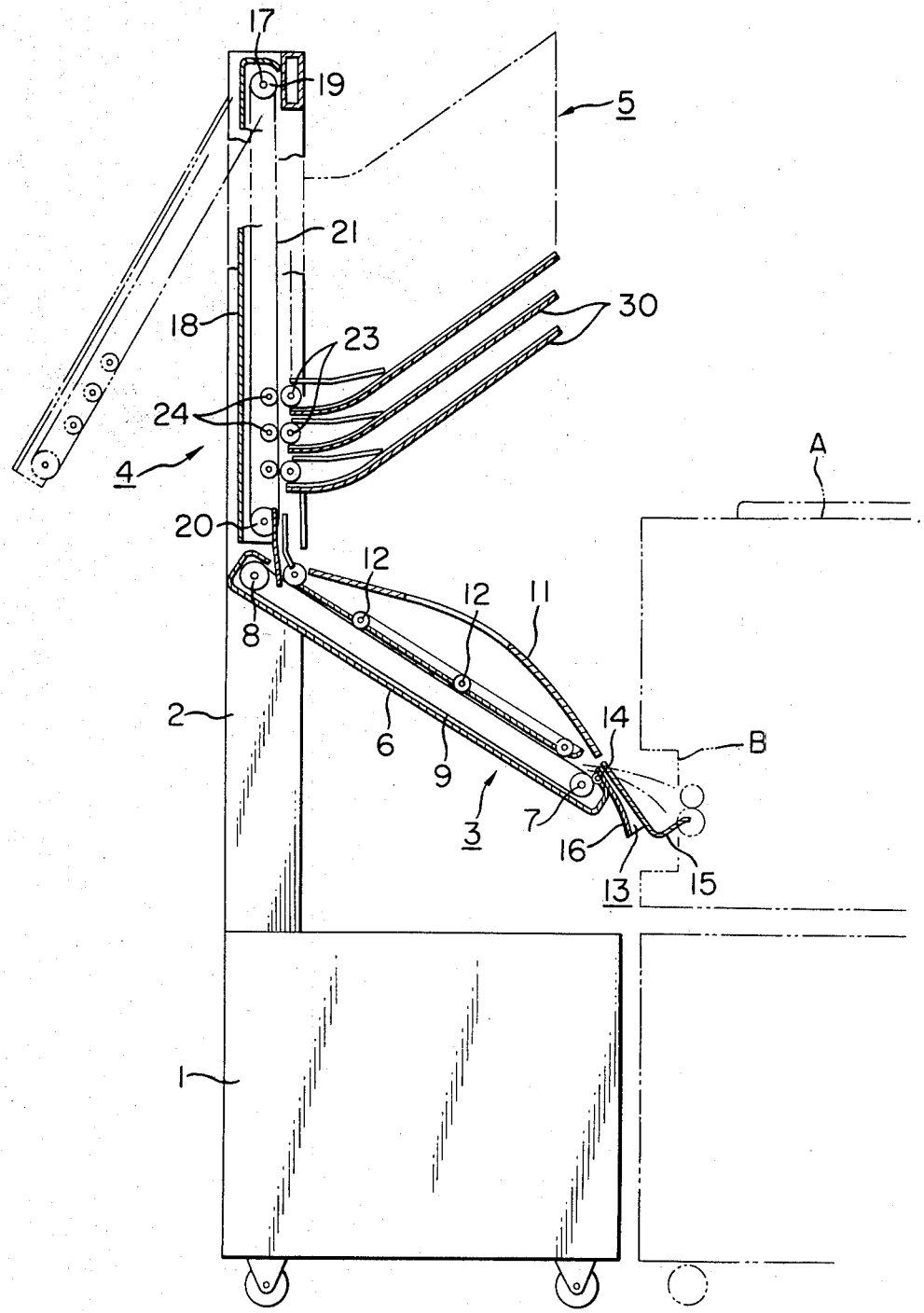
FIG. 2 is a sectional view of the inventive sorter.

As shown in FIG. 2, the front end of sheet receiving means 3 (facing the ejecting portion B of copying apparatus A) is provided with a deflecting means 13 for distributing copy sheets discharged from ejecting portion B to either sheet receiving and transporting means 3 or main tray 11. Deflecting means 13 comprises an upper plate 15 which constitutes an integral part of main tray 11 and a lower plate 16 which guides copy sheets discharged from ejecting portion B to sheet receiving means 3 when the deflecting means is upturned in the manner shown by the dash-and-double-dotted-lines in FIG. 6. Deflecting means 13 is maintained in its first or lowered position seen in FIG. 2 by means of conventional electromagnetic solenoids excited by an interruption copying signal, a signal indicating the use of special paper sheets, and/or an urgency stop signal indicating a jam in the sorter, or by some other mechanisms, thereby ejecting the so-called interruption copy sheets and/or transitional copy sheets onto main tray 11.

As will be appreciated from the foregoing description, deflecting means 13 is mounted on a shaft 14 so as to be rotated or swingable therewith and is so constructed that when the deflecting means is in its home or first position shown in FIG. 2, the upper surface of plate 15 forms—in conjunction with main tray 11—a continuous surface to assure smooth movement of a copy sheet, and further so that when it in its second position (FIG. 6), an ejected copy sheet is led between transport belts 9 and driven rollers 12.

Figure 3:
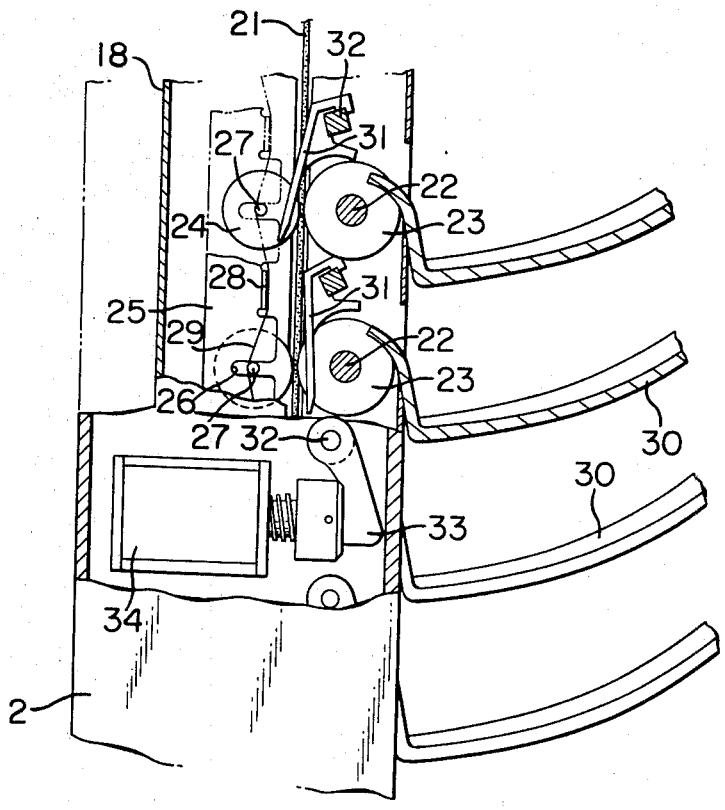
FIG. 3 is an enlarged showing with a partial cutaway view of one principal portion of the sorter.

Copy sheets transported by sheet receiving and transporting means 3 are next received by vertically extending distribution transport means 4 which is connected to the rear end of means 3. Distribution transport means 4 includes a mounting plate 18 pivotable about a horizontal shaft or axis 17 atop support frame 2 to the open position indicated with imaginary lines in FIG. 2. Pulleys 19 and 20 rotatably fixed to the upper and lower ends, respectively, of mounting plate 18 are interconnected through endless transport belts 21. The surfaces of these transport belts 21 are in contact with a number of sheet ejecting rollers 23 which are rotatably mounted about horizontal axles 22 (FIG. 3) disposed in vertically equidistant, spaced apart relation to one another. To keep these ejecting rollers 23 in contact with the surfaces of belts 21, auxiliary rollers 24 are provided correspondingly opposite ejecting rollers 23 with respect to the belts. Auxiliary rollers 24 are mounted on axles 27 supported between notches 26 of a frame 25, as shown in FIG. 3. Axles 27 are pressed or urged toward ejecting rollers 23 by means of a tensioned wire 29 alternately trained over protuberances 28 of frame 25 and axles 27.

Above main tray 11, a sorting means 5 is fixed to support frame 2. Sorting means 5 comprises a plurality of vertically aligned bins 30, the bases of which correspond to the respective ejecting rollers 23.

The entrance of each sorting bin 30 is provided with a gate or guide member 31 (FIG. 3). These gate members 31 are fixed to respective axles 32 mounted on support frame 2 and are operable by means of electromagnetic solenoids 34 connected to levers 33 provided at the ends of axles 32. Thus, when any one of these solenoids 34 is excited, the end of the corresponding gate member 31 is advanced into the copy sheet transport path consisting of transport belts 21 and ejecting rollers 23, thereby causing the transported copy sheets to be ejected from the path onto the corresponding bin 30.

Figure 4:
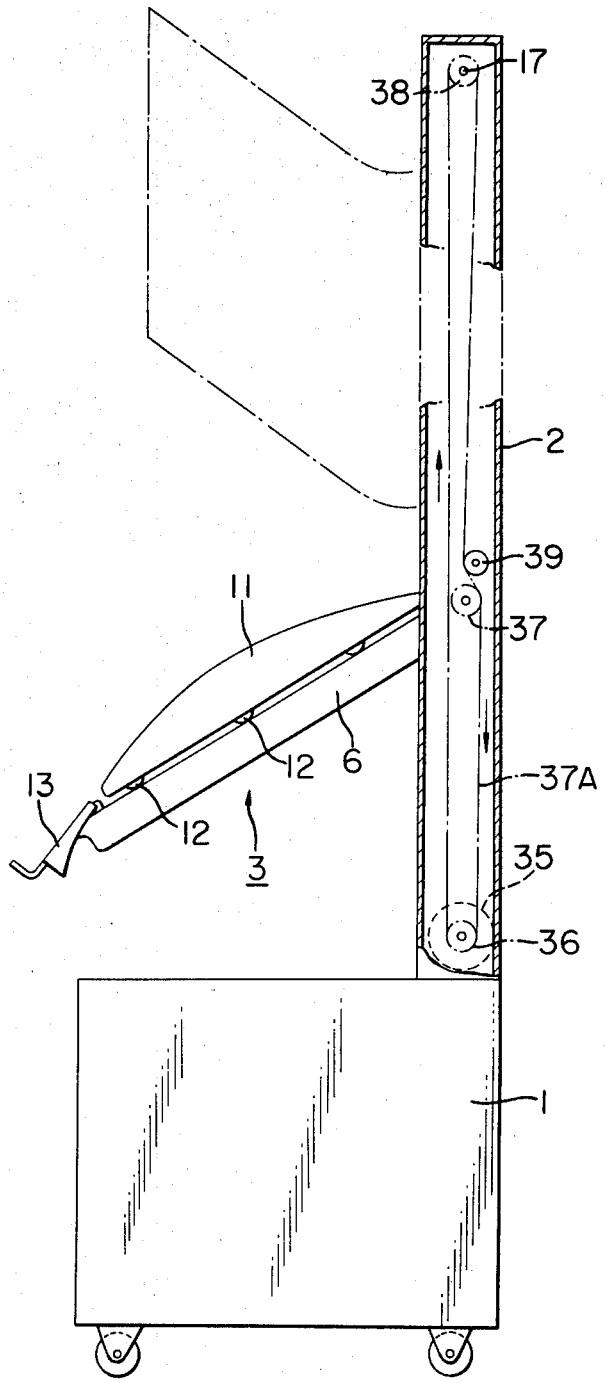
FIG. 4 is a sectional view of the drive system portions of the sorter.

FIG. 4 additionally shows the drive system of the foregoing sorter, wherein timing belts 37A trained over a drive pulley 36 of a drive motor 35 installed below support frame 2 are also trained over driven pulleys 37, 38 and 39.

Figure 5:
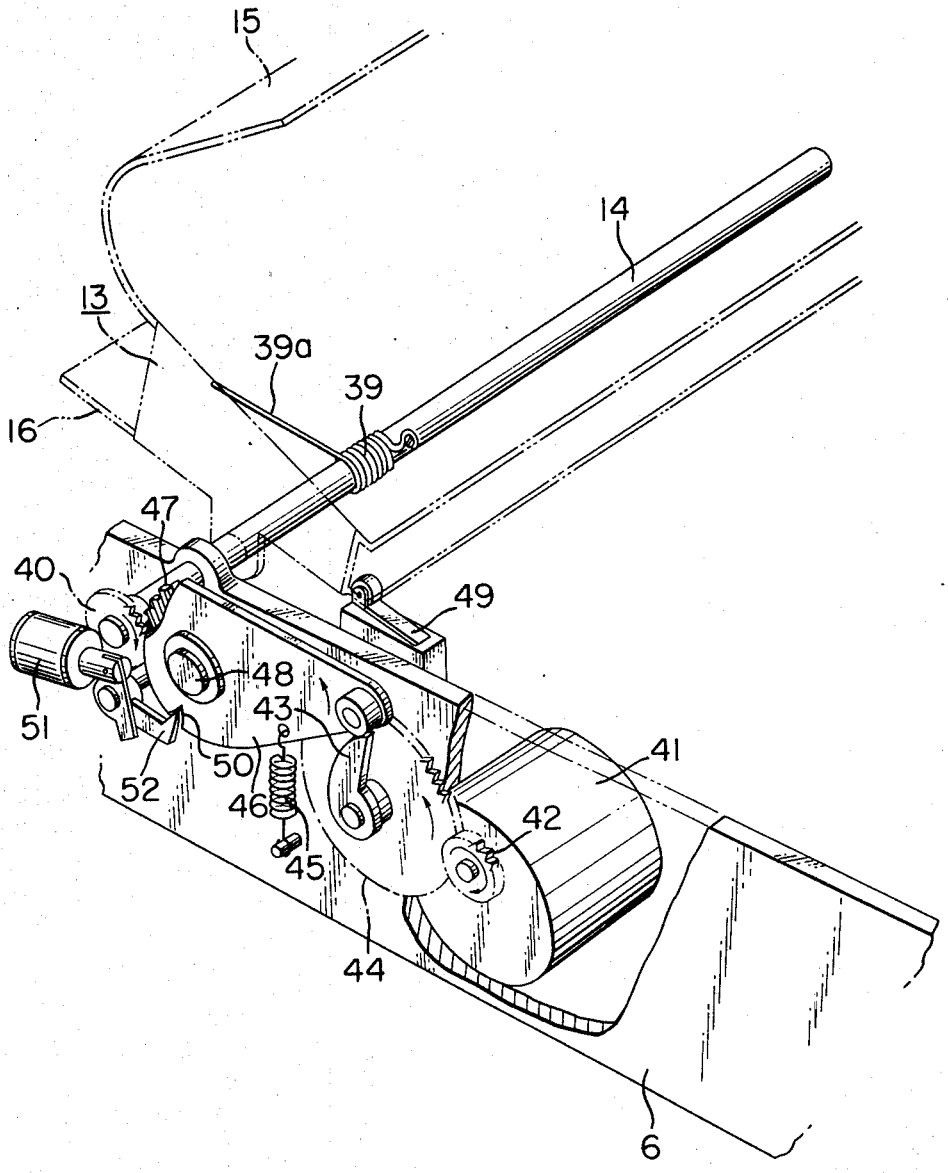
FIG. 5 is a perspective view of the drive and control sections of the sorter.
Figure 6:
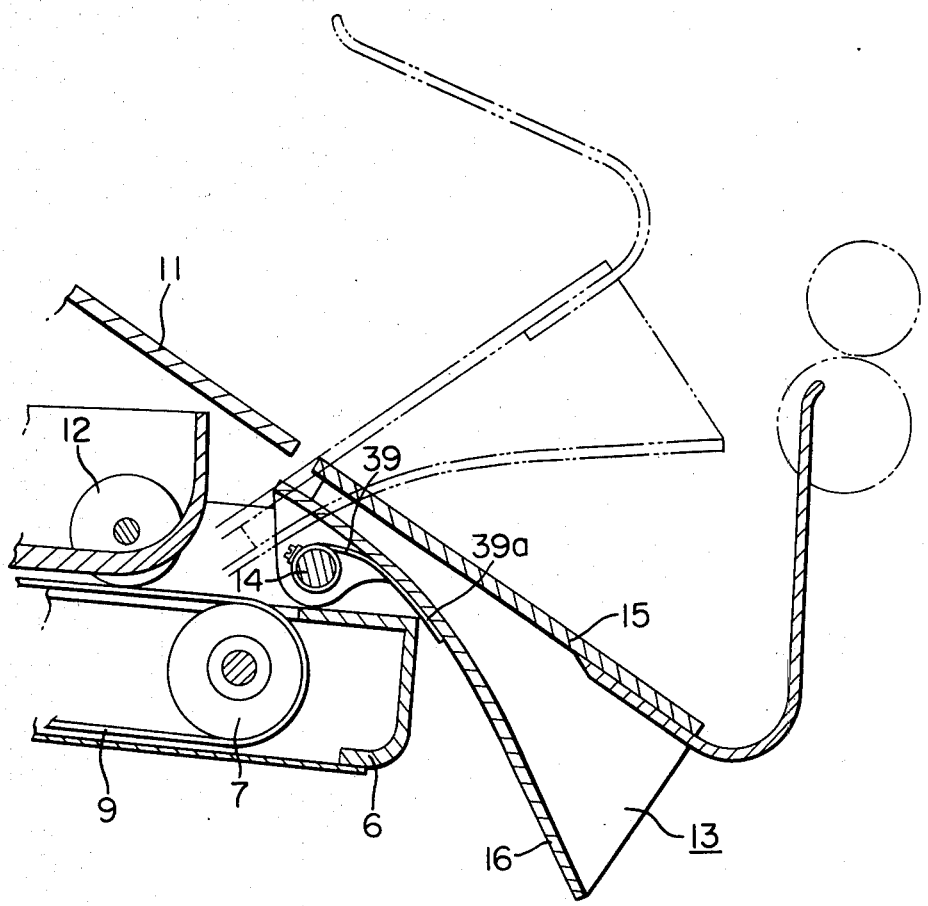
FIG. 6 is an enlarged sectional view of the deflecting means.

FIGS. 5 and 6 are enlarged showings of the details of the support and drive systems of deflecting means 13 wherein, as has been mentioned, upper plate 15 and lower plate 16 are supported by shaft 14 so as to be firmly and positively pivotable. Shaft 14—which is pivotable for deflection of sheets by a drive means described hereinafter—carries a fixed spring 39 to prevent overloading of the drive means, the free ends 39*a* of spring 39 pressing against the bottom surface of lower plate 16 to shoulder the weight of deflecting means 13. As should become apparent from the following description, spring 39 need not necessarily be provided in this position, but, in effect, any alternative force-regenerative means may be substituted at an appropriate portion of the drive system which transmits the changeover or sheet deflection movement.

FIG. 5 illustrates the details of the drive and control systems of deflecting means 13. Shaft 14 is interlocked to the changeover position by means of a spur gear 40 provided at the end thereof; that is, a pinion 42 mounted on the output shaft of a control motor 41 incorporated in rack 6 is rotatable in the direction indicated by the accompanying arrow and is engaged or meshed with a reduction gear 44 which is unitarily constructed with or otherwise fixed to a cam 43. A driven lever 46 urged downward by a spring 45 presses against eccentric cam 43 through a roller (no reference symbol) mounted on one end of the lever, while being rotatably supported by a shaft or stud (no reference symbol) at the other end thereof. A sector gear 47 mounted on the same shaft with lever 46 is meshed with spur gear 40 on shaft 14. Therefore, when it is desired to send copy sheets to the bins 30 following completion of interruption copying, motor 41 is rotated to pivot driven lever 46 on its axis 48 in accordance with the posture of cam 43, whereby shaft 14 is rotated in a clockwise direction through rotation of sector gear 47 (FIG. 5). Shaft 14 transmits this changeover movement to deflecting means 13 through spring 39 which shoulders the weight of the deflecting means.

Thus, control motor 41, upon receiving a signal from the copying apparatus indicating completion of the interruption, upturns or shifts deflecting means 13 from its first position indicated by solid lines to its second position shown in imaginary or dash-and-double-dotted-lines (FIG. 6). Although a microswitch 49 which senses attainment of the second position of means 13 directs motor 41 to stop, an electric circuit provided therefor automatically stops the motor in the event that microswitch 49 does not sense appropriate movement of deflecting means 13 within a predetermined period of time. The signal of microswitch 49 may also be utilized as that for enabling resumption of collating.

At the same time, a latch notch 50 is formed on the edge of driven lever 46. Latch notch 50 is so disposed that, in the second position of deflecting means 13, a latch pawl 52 operated by an electromagnetic solenoid 51 cooperatively engages in notch 50. Solenoid 51 is actuated at the predetermined time at which deflecting means 13 should be upturned to its second position so that, irrespective of whether deflecting means 13 has or has not been successfully raised, latch pawl 52 engages in latch notch 50 to lock shaft 14 in the position corresponding to the upturned state of deflecting means 13.

Thus, during normal collating by the sorter of the present invention, deflecting means 13 is raised to its second position indicated by imaginary lines in FIG. 6. Subsequently, when an interruption copying signal, or an urgency stop signal indicating a "jam", or a signal denoting use of special copy paper is given, such signals initially deenergize solenoid 51 to disengage latch pawl 52 from latch notch 50; driven lever 46—urged by spring 45—then descends to permit rotation of spur gear 40 in a counterclockwise direction (FIG. 5) through sector gear 47, thus shifting deflecting means 13 to its first or lowered position indicated by the solid lines in FIG. 6 whereby copy sheets discharged from the ejecting portion B of a copying apparatus A are thereafter stacked on main copy tray 11.

Upon completion of interruption copying, or special paper copying, or upon restoration to the preceding state, motor 41 resumes its revolution, thus returning deflecting means 13 to its second position. The process in this case may be described in further detail as follows: When the number of copied sheets stacked on main tray 11 is small, the weight imposed upon deflecting means 13 is correspondingly small so that the deflecting means is raised to its second position by the force of spring 39 whereby collating is immediately resumed. Where, on the other hand, the changeover to the sorting operation is performed while a large quantity of copied sheets remain stacked on main tray 11, motor 41 continues operation to activate the drive mechanism in the condition shown in FIG. 5 but, in this case, the weight of the copied sheets supported on deflecting means 13 is too large. Spring 39 is therefore bent such that deflecting means 13 fails to be raised to its second position and microswitch 49, which fails to sense the desired movement of deflecting means 13 even after the predetermined time period, directs motor 41 to stop and causes a copy sheet removal alarm to sound to thereby call for manual removal of the copied sheets from main tray 11. When the copied sheets are removed, the control system up to shaft 14 is already changed to the condition corresponding to the second position of means 13—and is there locked by latch pawl 52—so that deflecting means 13 is automatically raised by the urgency of spring 39; microswitch 49, which then confirms the change in position of means 13, immediately directs resumption of the collating operation.

As described, since most of the weight of copy sheets in the inventive apparatus is imposed on main tray 11, the weight shared by upper plate 15 is small, so that deflecting means 13 may be freely raised from its lowered, first position irrespective of whether or not copy sheets are present on main tray 11. Inasmuch as the collating operation may generally be resumed immediately after completion of interruption copying or the like, the efficiency of copying work may be substantially increased. All that the operator need do during copying work is to remove the stacked copy sheets when an alarm sounds indicating that a specific large quantity of copy sheets are piled atop deflecting means 13; the operator can accordingly attend to other business work at the same time. Those skilled in the art will, of course, recognize that the height and configuration of the bent portion formed at the front end of deflecting means 13 can be determined in planning as a matter of design choice.

What is claimed is:

1. In a sheet sorter including sheet sorting means, sheet receiving and transporting means for conveying sheets to the sorting means, and a main tray overlying the receiving and transporting means for receiving sheets in stacked relation thereon, sheet deflecting means at a sheet inlet end of the receiving and transporting means and comprising an upper plate and a lower plate positionally fixed in spaced apart relation to each other, said deflecting means being pivotally movable between a first position in which sheets input to the sorter are directed by said deflecting means onto the main tray and wherein said upper plate forms a substantially smooth continuation of the main tray to partially support sheets received in stacked relation on the main tray, and a second position in which sheets input to the sorter are directed by said deflecting means to the receiving and transporting means for conveyance to the sorting means, and drive means connected to said deflecting means for moving the same between said first and second positions thereof so that sheets input to the sorter are caused to be either stacked on the main tray or conveyed to the sorting means, respectively, said upper plate of the deflecting means being so configured that when said upper plate forms a substantially smooth continuation of the main tray in said first position of said deflecting means to partially support sheets stacked on the main tray said upper plate supports only a relatively small portion of the stacked sheets with respect to that portion supported by the main tray so as to facilitate free movement of said deflecting means to its second position while partially supporting sheets thereon.

2. In a sheet sorter in accordance with claim 1, force regenerative means connecting said drive means to said deflecting means for conveying a moving force to said deflecting means, and said drive means being operable to shift between a first condition in which said force regenerative means causes said deflecting means to assume its first position and a second condition in which said force regenarative means causes said deflecting means to assume its second position so long as the moving force conveyed by said force regenerative means is greater than the weight of sheets partially supported on said upper plate of the deflecting means, such that where said drive means is shifted to its second condition and the weight of sheets partially supported on the upper plate exceeds the moving force conveyed by said force regenerative means, the deflecting means is not moved to its second position until the sheets supported on its upper plate are removed therefrom so as to avoid damage to said drive means.

3. In a sheet sorter in accordance with claim 2, said force regenerative means comprising a spring.

4. In a sheet sorter in accordance with claim 3, said spring being connected to said deflecting means at said lower plate thereof.

5. In a sheet sorter in accordance with claim 3, said drive means including a shaft rotatable in accordance with the first or second condition of said drive means, and said spring being positionally fixed on said shaft so that rotation of said shaft is transmitted through said spring to said deflecting means.

* * * * *